US009624613B2

(12) United States Patent
Butler

(10) Patent No.: US 9,624,613 B2
(45) Date of Patent: Apr. 18, 2017

(54) METHOD AND SYSTEM OF CREATING A QUILTED PRODUCT

(71) Applicant: Ann Marie Butler, Villard, MN (US)

(72) Inventor: Ann Marie Butler, Villard, MN (US)

( * ) Notice: Subject to any disclaimer, the term of this patent is extended or adjusted under 35 U.S.C. 154(b) by 407 days.

(21) Appl. No.: 14/137,466

(22) Filed: Dec. 20, 2013

(65) Prior Publication Data

US 2014/0182098 A1 Jul. 3, 2014

Related U.S. Application Data

(60) Provisional application No. 61/848,351, filed on Dec. 31, 2012, provisional application No. 61/774,369, filed on Mar. 7, 2012, provisional application No. 61/839,940, filed on Jun. 27, 2013.

(51) Int. Cl.

| | |
|---|---|
| ***B41K 1/04*** | (2006.01) |
| ***D06C 29/00*** | (2006.01) |
| ***B41K 1/34*** | (2006.01) |
| ***D06B 11/00*** | (2006.01) |
| ***D06C 23/04*** | (2006.01) |

(52) U.S. Cl.

CPC ..... *D06C 29/00* (2013.01); *B41K 1/04* (2013.01); *B41K 1/34* (2013.01); *D06B 11/0076* (2013.01); *D06C 23/04* (2013.01)

(58) Field of Classification Search

CPC ... B41K 1/02; B41K 1/04; B41K 1/06; B41K 1/34; B41F 17/38; D06C 23/00; D06C 29/00; D06B 1/10; D06B 11/0076

See application file for complete search history.

(56) References Cited

U.S. PATENT DOCUMENTS

| | | | | |
|---|---|---|---|---|
| 5,313,885 | A * | 5/1994 | Winston | B41K 1/56 101/405 |
| 6,910,418 | B1 * | 6/2005 | Yu | B41K 1/04 101/103 |
| 2010/0221429 | A1 * | 9/2010 | Ahn | B41M 1/06 427/256 |
| 2011/0146513 | A1 * | 6/2011 | Yeomans | B25F 1/02 101/333 |

OTHER PUBLICATIONS

Youtube video titled "Faux Quilt Card with Dawn" by Dawn published on Apr. 1, 2009.*

* cited by examiner

*Primary Examiner* — Blake A Tankersley

(74) *Attorney, Agent, or Firm* — Braxton, Hilton & Perrone, PLLC

(57) ABSTRACT

A method and system of creating a quilted product. A method for the creation of a quilted product includes using a first stamp to apply a coloring liquid to a blank surface to create a first quilted piece. Then, a second stamp is used to apply a coloring liquid to a blank surface to create a second quilted piece. The second quilted piece is adjacent to the first quilted piece such that it abuts against the first quilted piece. Neither the first stamp nor the second stamp comprise an added allowance.

10 Claims, 9 Drawing Sheets

Fig 1
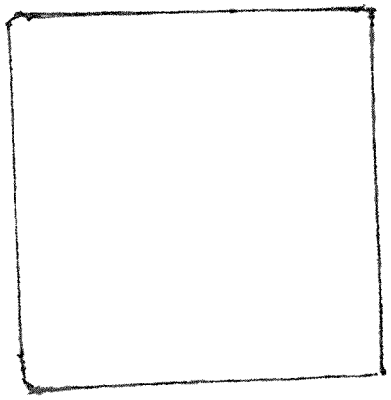
Fig 2
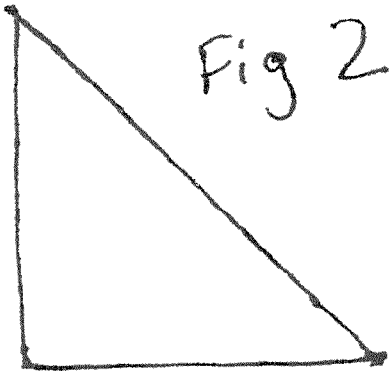
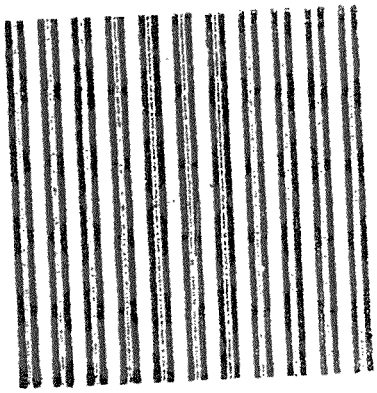
Fig 3
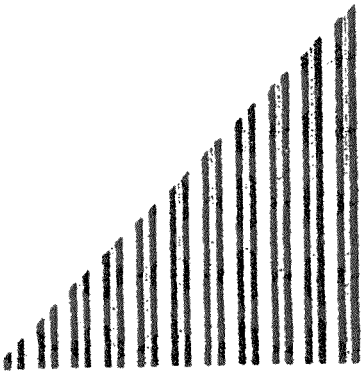
Fig 4

METHOD AND SYSTEM OF CREATING A QUILTED PRODUCT

CROSS-REFERENCE TO RELATED APPLICATION

This application claims the benefit of: (1) provisional U.S. Application No. 61/848,351 entitled "Faux Quilting" filed Dec. 31, 2012; (2) provisional U.S. Application No. 61/774,369 entitled "Method and System for Creating a Quilted Product" filed Mar. 7, 2013; and (3) provisional U.S. Application No. 61/839,940 entitled "Method and System of Creating a Quilted Product" filed Jun. 27, 2013, the technical disclosures of which are incorporated herein in their entirety.

BACKGROUND OF THE INVENTION

Technical Field

The present invention relates to a method and system for making a product which resembles a quilt.

Description of Related Art

Quilting as an art form is an art form many enjoy but it can be time consuming and can take weeks, months even years to complete a quilt. Further, quilting requires an excess of material and is expensive. While traditional quilting is a true art form not everyone wants or has the time to spend creating quilts. Consequently, there is a need for a method and system which allows non-quilters and those who do not have the skill or time for quilting, to create a product which resembles a quilt out of fabric quickly and easily.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

FIG. 1 is a top view of a stamp without added allowance in one embodiment;

FIG. 2 is a top view of a triangular stamp without added allowance in one embodiment;

FIG. 3 is a top view of a patterned stamp in one embodiment;

FIG. 4 is a top view of a patterned stamp comprising a triangle in one embodiment;

DETAILED DESCRIPTION

Figure 5:
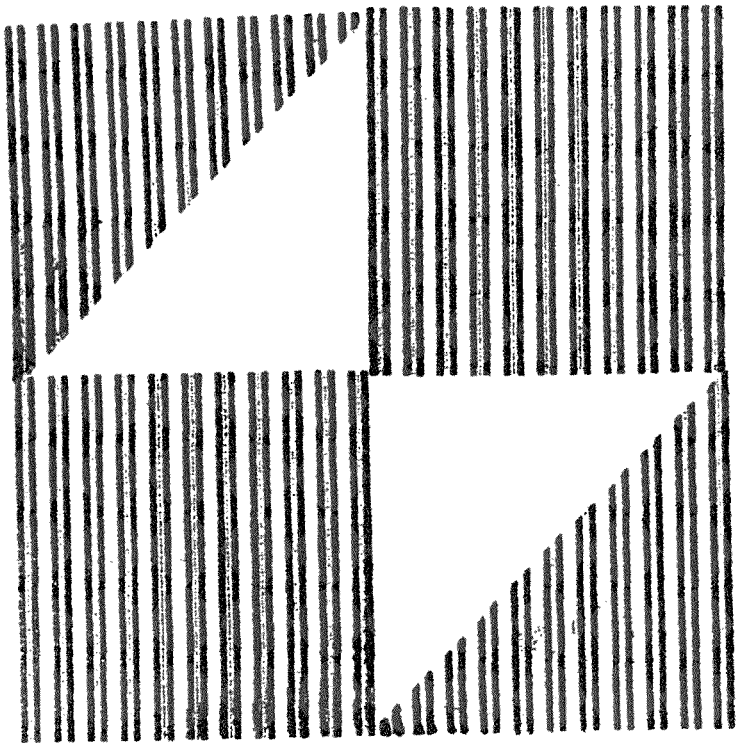
FIG. 5 is a top view of a quilted product utilizing a plurality of stamps in one embodiment.

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

In traditional quilting, pieces of fabric are sewed together to form a quilt top. First a pattern is selected. Then, individual pieces of fabric are cut in desired shapes. When cutting, more material than is needed is utilized to provide sufficient material to allow the piece to be sewn next to adjacent pieces. This is referred to as an added allowance. For example, in prior art sewing a border of about ¼ of an inch is typically left around the perimeter of each piece. Thus, if the pattern calls for a one inch square, the fabric is cut to a 1.5 inch by 1.5 inch square to provide for the ¼ of an inch border. After the fabric is cut, each individual piece is sewed to adjacent pieces to form a quilt top. The quilt top is then sewed to a backing to form a quilted blanket. Those skilled in the art understand that cutting the fabric, and quilting them to adjacent pieces, is very time consuming.

In one embodiment a quilted product is created without using the traditional cutting, matching seams, angles, and corners, discussed above. In one embodiment the method utilizes a stamp to create a single quilted piece. A single quilted piece, as used herein, refers to a distinct shape which can be combined with other shapes to form a patchwork quilt. A stamp, as used herein, refers to a stamp, die, or other device known for controlling the application of a coloring liquid. The stamp can comprise a stamp, a stencil, a die, a die cut, as well as other objects. A coloring material, as used herein, refers to any material which is applied to provide a color to an object and include, but is not limited to ink, paint, and other such material.

In one embodiment a quilted product is made using a blank surface. The blank surface can comprise any type of material, including fabric, cardboard, clay, metal, cardstock, foam, mat board, paper, and virtually any material which can be painted or have an item affixed thereto. In one embodiment the blank surface is white, whereas in other embodiment the blank surface comprises color. A stamp is used to apply a coloring material to a blank surface to create a single quilted piece.

FIG. 1 is a top view of a stamp without added allowance in one embodiment. As depicted, the stamp comprises a 2 inch square but this is not limiting, as will be discussed below herein. For example, the stamp can comprise a variety of shapes including but not limited to squares, circles, triangles, rectangles, diamond shapes, fan shapes, and any geometric shape. Likewise, the stamps can comprise virtually any size. In one embodiment the size ranges from about ½"-12".

As shown, the stamp in FIG. 1 does not have an additional allowance. Put differently, there is no additional border around the perimeter of the stamp. As noted, in quilting, a 2 inch square piece of fabric would normally be cut to a 2.5 inch by 2.5 inch square to provide for a border, or an added allowance. As depicted, the 2 inch square does not have a border, and thus does not have an added allowance. Thus, a 2 inch square stamp of FIG. 1 will produce a 2 inch square quilted piece when the stamp is applied to a blank surface.

Because the stamp, in one embodiment, does not comprise an added allowance, the stamp can produce a quilted piece which abuts directly next to an adjacent quilted piece. Accordingly, for example, six two-inch wide quilted pieces can fit within one foot because there are no added allowances. Further, in such an example, each piece abuts directly next to an adjacent piece. This is because, contrary to prior art quilting, adjacent pieces are not sewed together. Instead, a first piece is stamped and then a second adjacent piece is stamped. As such, in one embodiment the adjacent quilted pieces each fit perfectly like a puzzle creating a quilted product. The stamp can comprise any type of material which can control application of a coloring liquid. Thus, the stamp can comprise plastic, rubber, metal, wood, and other materials. The stamp can be opaque or transparent. A transparent stamp is a stamp wherein at least a portion of the stamp is transparent. A transparent stamp has the advantage in that the user can see through the stamp and view the location of the below material. This advantage aids the user in carefully applying the stamp. In one embodiment, even after coloring liquid is applied to the stamp, at least a portion of the stamp remains transparent. The transparent stamps can comprise any transparent or semi-transparent material and can include, but is not limited to, photopolymer, polymer, polymer liquid, silicon, acrylic and other transparent materials.

FIG. 2 is a top view of a triangular stamp without added allowance in one embodiment.

FIG. 3 is a top view of a patterned stamp in one embodiment. A patterned stamp is any stamp which comprises a pattern. As depicted it is a two inch by two inch square. If the stamp comprises a traditional stamp, the pattern is located on the stamp. If the stamp comprises a die, the die comprises a pattern for embossing. Thus, when a user die cuts fabric it would only cut the two inch by two inch square out.

FIG. 4 is a top view of a patterned stamp comprising a triangle in one embodiment.

FIG. 5 is a top view of a quilted product utilizing a plurality of stamps in one embodiment. As can be seen in FIG. 5, one or more stamps can be utilized to create a quilted product. As depicted, the quilted product in FIG. 5 is made using the stamp from FIG. 4 in the top left and bottom right segments. The stamp from FIG. 3 is used on the bottom left and top right segments. Thus, in one embodiment two or more stamps are utilized to create a quilted product.

In creating the quilted product of FIG. 5, in one embodiment, a pattern is first selected. Next a blank surface is selected. In one embodiment the blank surface is large enough to contain the selected pattern. Next, stamps which do not have added allowance are selected. The first stamp can be applied in either of the four locations in FIG. 5. Put differently, the user can start at the top left, top right, bottom left, or bottom right. A coloring liquid is first applied to the stamp. This can be accomplished by dipping the stamp into a containing which comprises coloring liquid, applying coloring liquid to the surface of a stamp, of any method of applying coloring liquid so that the stamp can transfer the coloring liquid to the blank surface. In one embodiment, a stencil is used to cover all or a portion of the surface and the coloring liquid is applied directly to the surface. In another embodiment, two or more stamps are used to create a single quilted piece. Thus, a first stamp can be used to apply a base color, for example. Then, a second stamp is applied over the same quilted piece to create a pattern. In this fashion, two or more colors can be utilized in a single quilted piece.

After applying the coloring liquid to the stamp, the stamp is pressed upon the blank surface to create a first quilted piece. In one embodiment the blank surface is first ironed to smooth out the surface and remove any wrinkles Next, a stamp is aligned adjacent to the first quilted piece, to create a second quilted piece. This process is repeated until a quilted product is created. The first and second stamps can comprise dissimilar shapes and/or sizes. In another embodiment the first and second stamp comprise a single stamp. In one embodiment the first and second stamp comprise the same stamp, but the stamp utilizes dissimilar colors.

As noted, in one embodiment the stamps do not comprise an added allowance. Thus, they do not have any border or lip which extends outside the periphery of the stamping surface. Put differently, a lip or border does not extend beyond the image. A lip or other such border would prevent stamps from abutting an adjacent piece.

Figure 6:
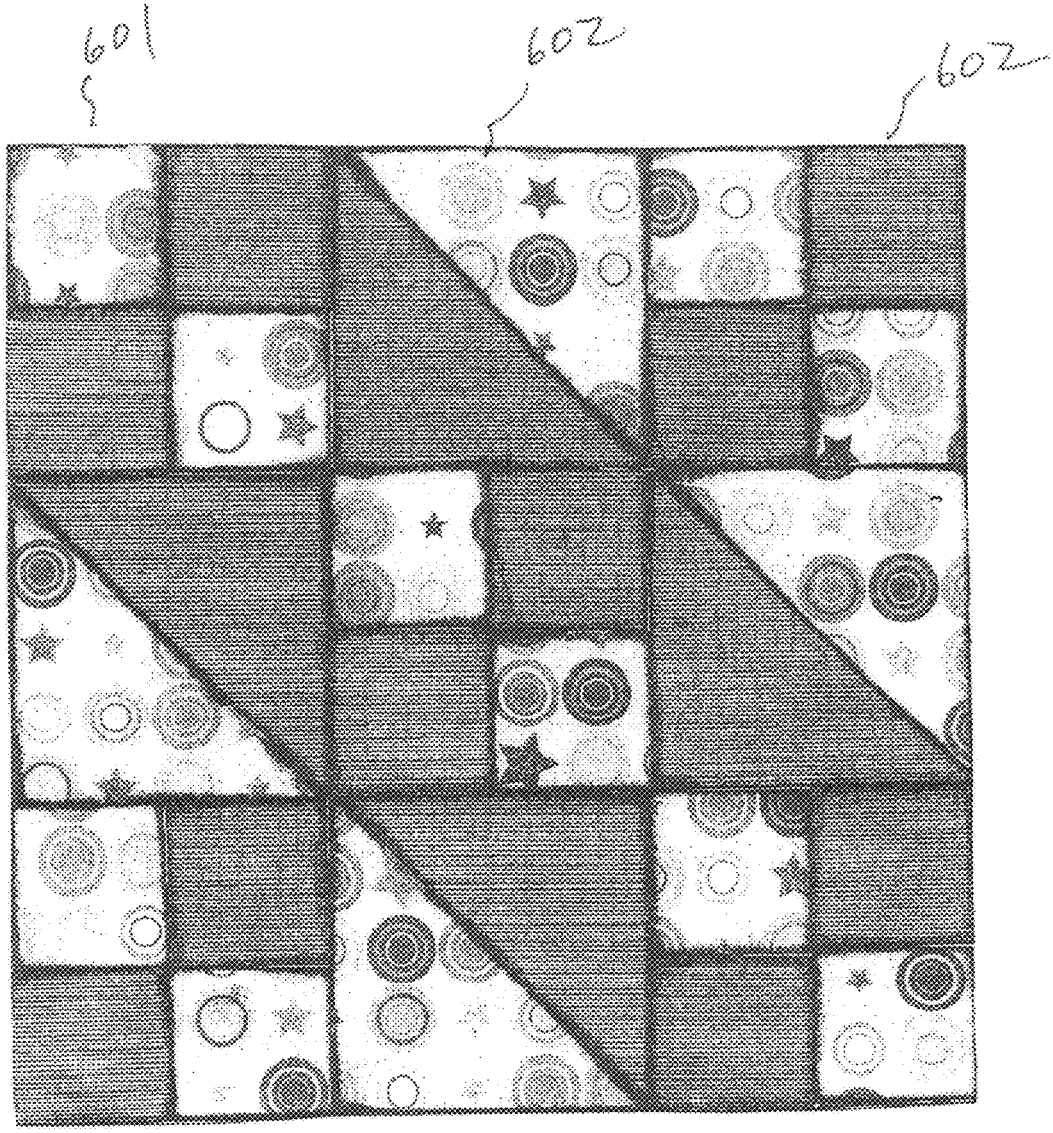
FIG. 6 is a top view of a quilted product comprising a pattern of "Jacob's Ladder" in one embodiment.

FIG. 6 is a top view of a quilted product comprising a pattern of "Jacob's Ladder" in one embodiment. As depicted, the quilted product comprises a 6 inch block, which is six inches tall and six inches wide. As can be seen, stamps of different sizes and shapes are utilized. For example, a one inch by one inch stamp is utilized for the top left quilted piece 601. A two inch tall by two inch wide triangular stamp is used for the middle quilted piece 602.

Further, while stamps of different shapes and sizes are utilized, shapes of different patterns and colors can also be utilized. For example, as shown, the top left quilted piece 601 comprises a different pattern than the top right quilted piece 602. The patterns can vary in shape, color, etc.

Figure 7:
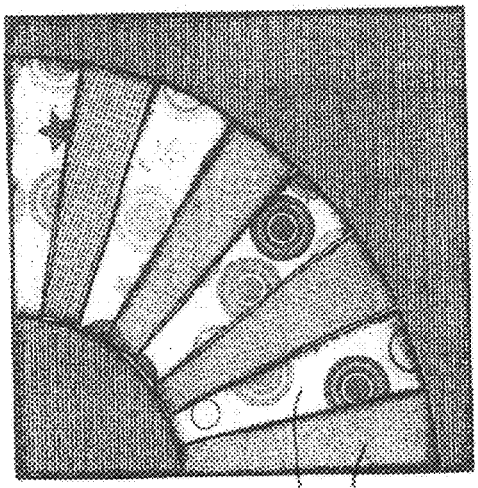
FIG. 7 is a top view of a quilted product comprising "Grandmother's Fan" in one embodiment.

FIG. 7 is a top view of a quilted product comprising "Grandmother's Fan" in one embodiment. As depicted, a single stamp is utilized to create the fan quilted pieces 704. In use, a first stamp is used as discussed above to create a quilted piece 704. Then a coloring liquid is applied to the same or different stamp, the stamp is aligned with the first quilted piece 704, and a second quilted piece 705 is created. As stated previously, the stamp to create the second quilted piece 705 is aligned perfectly adjacent to the first quilted piece 704. Put differently, there is no seam allowance provided between the two adjacent quilted pieces. The rest of the fan is created using the same method.

Figure 8:
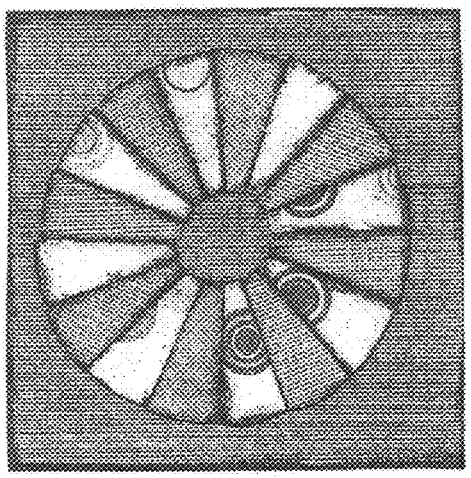
FIG. 8 is a top view of a quilted product comprising "Dresden Plate" in one embodiment.

FIG. 8 is a top view of a quilted product comprising "Dresden Plate" in one embodiment. The fan stamps discussed above with reference to FIG. 7 are utilized to create the fan shape.

Figure 9:
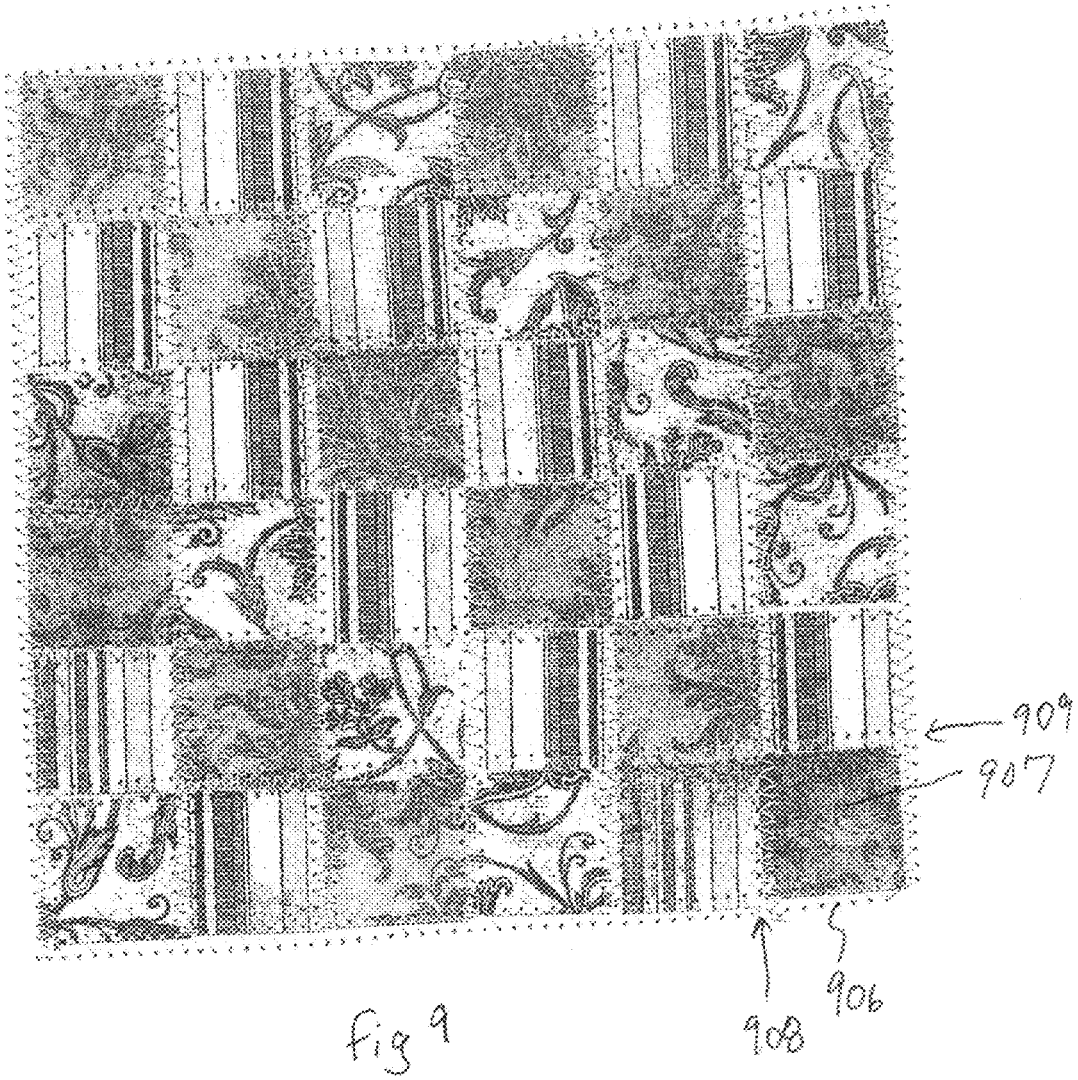
FIG. 9 is a top view of a quilted product comprising stitching in one embodiment.

FIG. 9 is a top view of a quilted product comprising stitching in one embodiment. In one embodiment, after the quilted pieces have been created to create a quilted product, stitching 906 can be added. Stitching can comprise any material known for stitching including yarn and thread. Stitching makes the quilted product more resemble a quilted top.

As depicted the bottom right quilted piece 907 comprises stitching 906 around its entire perimeter. This is for illustration purposes and should not be deemed limiting. In one embodiment stitching is applied to each quilted piece 907 individually. In another embodiment, stitching can be applied in rows and columns. For example, a user can begin at the bottom right quilted piece 907 and stitch the entire bottom row along the top line 909. In this manner, several quilted pieces can be stitched simultaneously. Then, a user, beginning at the bottom right quilted piece 907 can stitch a line along the left vertical line 908. In such a manner, a 36 piece quilted product can be stitched in 7 trips in the horizontal direction and 7 trips in a vertical direction. This is faster and more efficient compared to the 144 trips it would take if each of the four sides of the 36 pieces were stitched individually.

Figure 10:
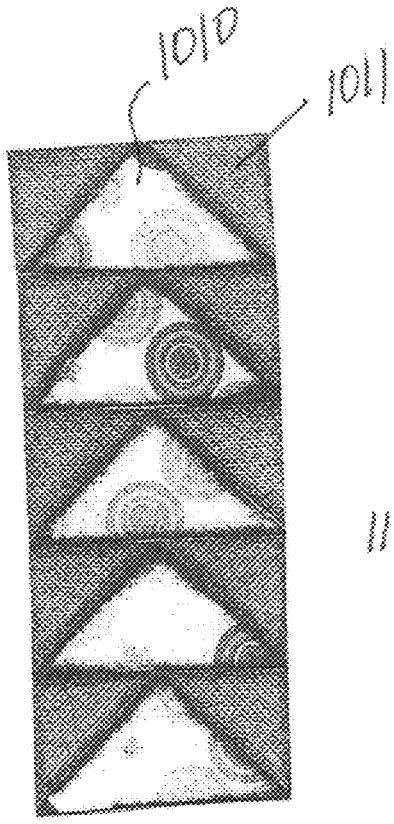
FIG. 10 is a top view of a quilted product comprising "Flying Geese" in one embodiment.

FIG. 10 is a top view of a quilted product comprising "Flying Geese" in one embodiment. In one embodiment this is created using 2 triangular shaped stamps. One is used for the internal triangle 1010, and the other is used for the smaller triangle 1011. As depicted the internal triangle 1010 comprises a pattern whereas the smaller triangle is plain.

Figure 11:
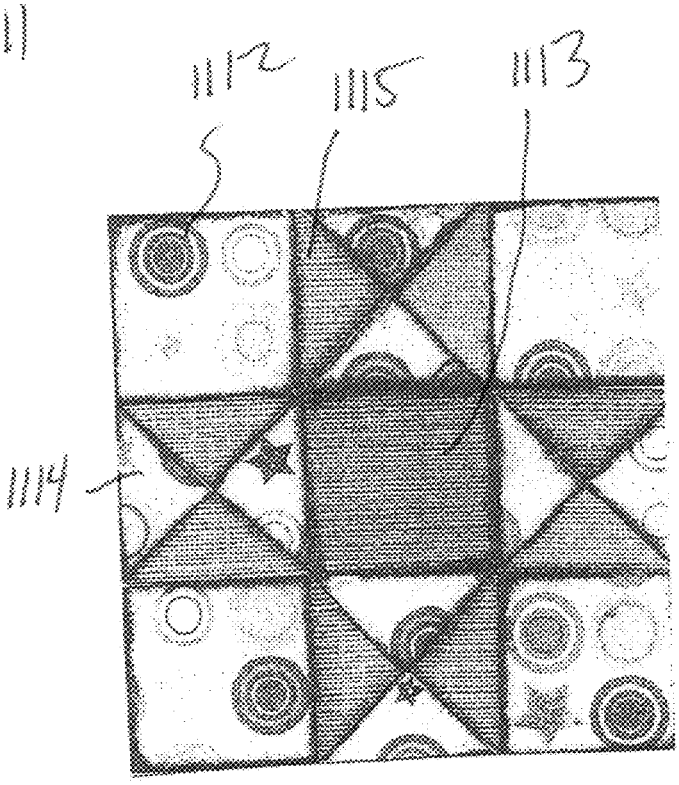
FIG. 11 is a top view of a quilted product comprising an "Ohio Star" in one embodiment.

FIG. 11 is a top view of a quilted product comprising an "Ohio Star" in one embodiment. In one embodiment this is created using a one inch square patterned stamp 1112, a one inch square plain stamp without a pattern 1113, a one inch triangle patterned stamp 1114, and a one inch triangle plain stamp 1115.

Figure 12:
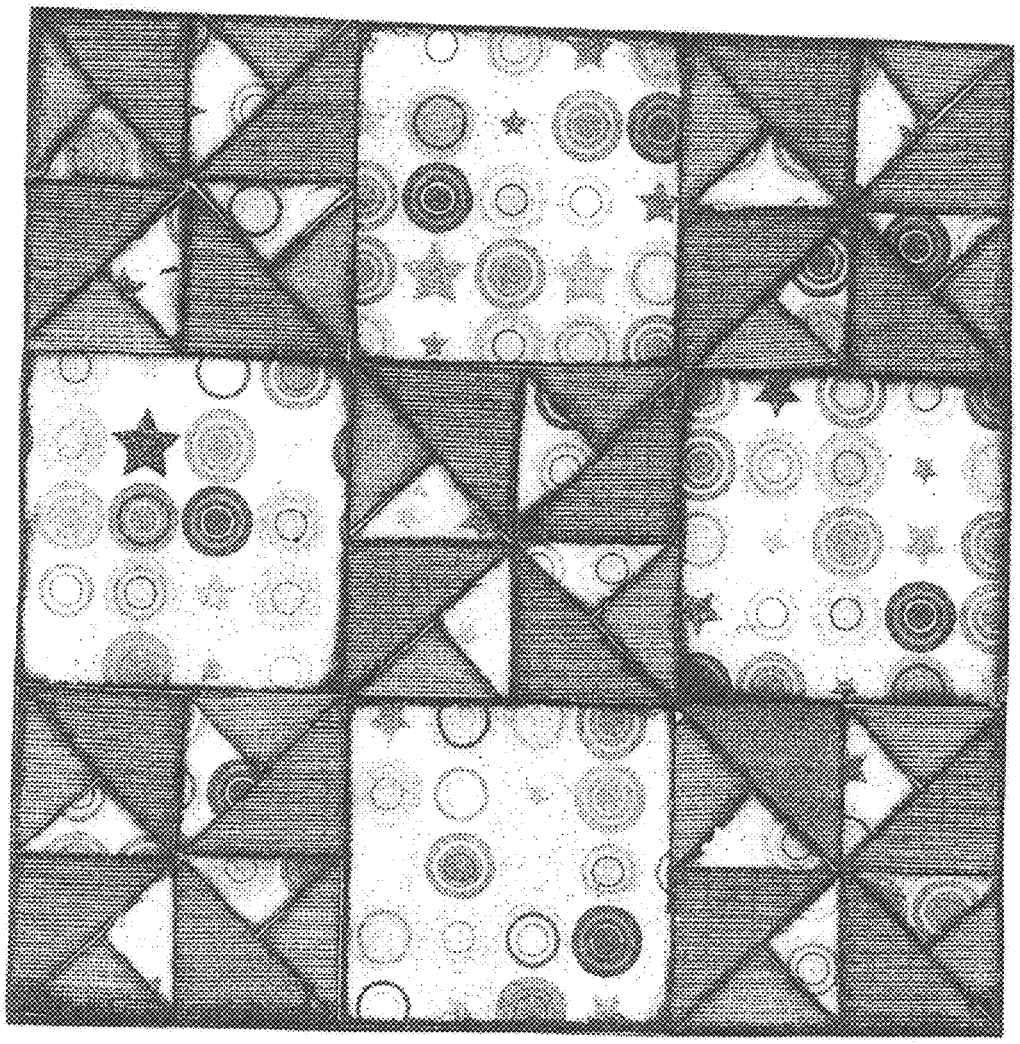
FIG. 12 is a top view of a quilted product comprising a "Pinwheel" in one embodiment.

FIG. 12 is a top view of a quilted product comprising a "Pinwheel" in one embodiment. In one embodiment this is created using a two inch square patterned stamp and an assortment of triangles of different sizes and patterns.

Figure 13:
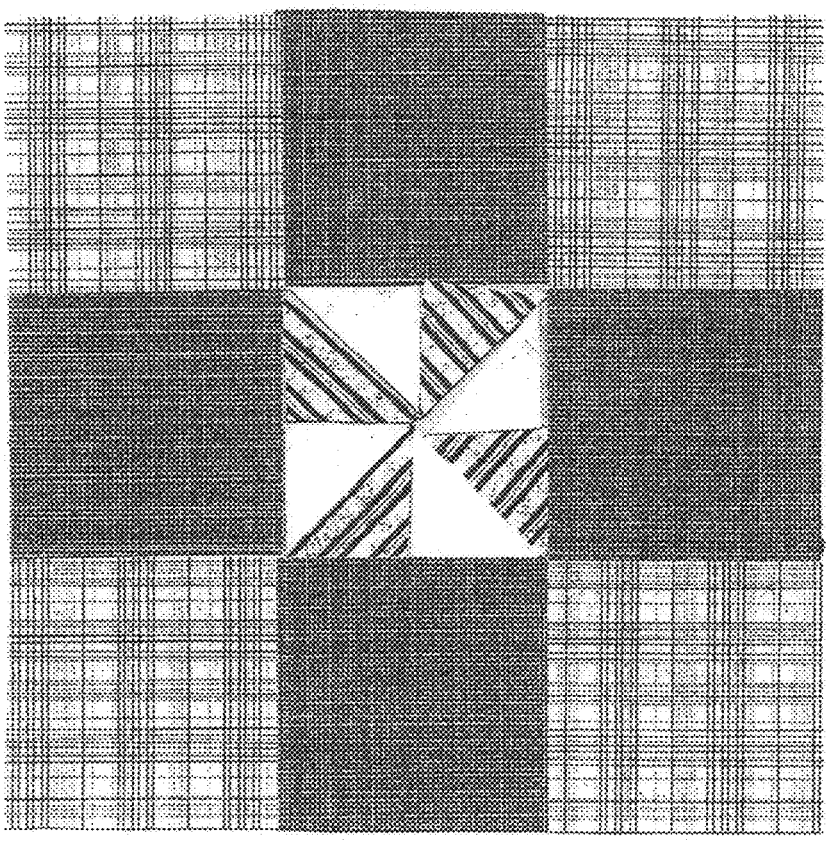
FIG. 13 is a top view of a quilted product comprising a two inch square and one inch triangles in one embodiment.

FIG. 13 is a top view of a quilted product comprising two inch squares and one inch triangles.

Figure 14:
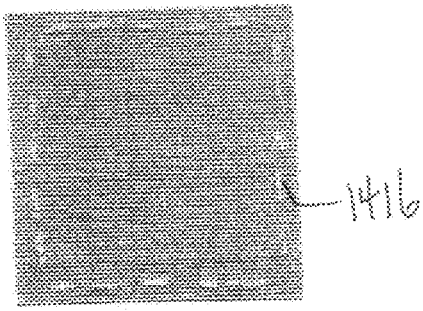
FIG. 14 is a top view of a two inch square comprising stitching lines in one embodiment.

FIG. 14 is a top view of a two inch square comprising stitching lines. The stitching lines 1416 can comprise the same or different materials as the stitching discussed in FIG. 9. As noted, the blank surface can comprise fabric, cardboard, cardstock, metal, and virtually any surface.

Figure 15:
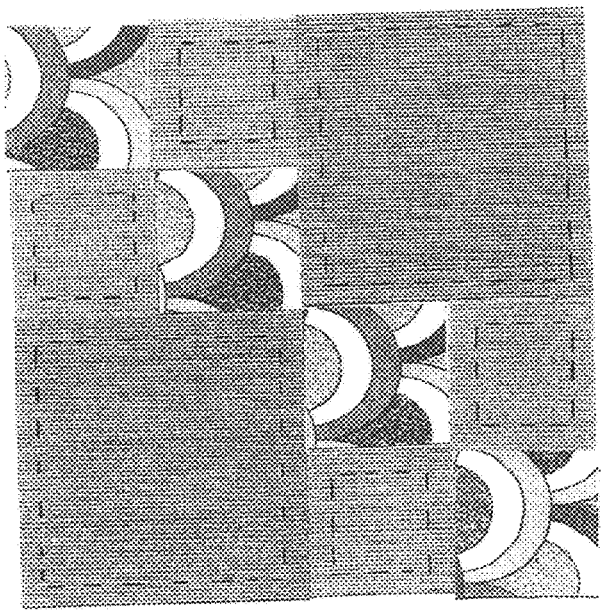
FIG. 15 is a top view of a quilted product comprising stitching lines in one embodiment.

FIG. 15 is a top view of a quilted product comprising stitching lines. As noted, stitching lines can be utilized to make a quilted top more resemble a traditional patchwork quilt.

As noted, in one embodiment there are no seam allowance or clipped corners. Instead, the stamps are created exact so that whatever material you are die cutting the shapes will fit together perfectly like a puzzle and create a quilted product.

In one embodiment, when working with fabric and using the stamps to make the quilted pieces, it only takes minutes to line up the stamps. Thereafter, in one embodiment, the quilted product is sandwiched with a batting and backing fabric to create a quilt which appears to be sewn.

As noted, while the term "stamp" has been utilized, this term includes a traditional stamp which is dipped into ink as well as dies and die cuts. For example, in one embodiment a stamp is used to apply a coloring liquid to a blank surface. In one embodiment utilizing a die cut, a die cut cuts single pieces of fabric, metal, or any type of material discussed herein. In one embodiment the single piece does not comprise an added allowance. Then, the cut single pieces are placed so that a first cut piece abuts directly next to an adjacent second cut piece. In this fashion, patterns can be created as discussed above. The cut pieces can also be embossed to create pieces with colors, patterns, etc. In one embodiment, the cut pieces are stamped so as to comprise a color, pattern, or design. A user can die cut and emboss materials such as but not limited to cardstock and metal to create a quilted product which can be framed, used as a book cover, an art quilt and more.

The material, once placed, in one embodiment, are secured to a backing. The placed pieces can be secured via any method known in the art including gluing, pasting, using an adhesive, sewing, clipping, etc.

In one embodiment a combination of stamps and die cutting is utilized to create a quilted product.

While the invention has been particularly shown and described with reference to a preferred embodiment, it will be understood by those skilled in the art that various changes in form and detail may be made therein without departing from the spirit and scope of the invention.

Additional Description

The following clauses are offered as further description of the disclosed invention.

1. A method for creating a quilted product, said method comprising:
   a. using a first stamp to apply a coloring liquid to a blank surface to create a first quilted piece;
   b. using a second stamp to apply a coloring liquid to said blank surface to create a second quilted piece, wherein said second quilted piece abuts against said first quilted piece, and wherein said first stamp does not comprise an added allowance, and wherein said second stamp does not comprise an added allowance.
2. The method according to clause 1 wherein said first stamp and said second stamp comprise a dissimilar shape.
3. The method according to any preceding clause wherein said first stamp and said second stamp comprise a dissimilar size.
4. The method according to any preceding clause further comprising stitching along a perimeter of at least one of said quilted pieces.
5. The method according to any preceding clause further comprising applying said blank surface to a backing.
6. The method according to any preceding clause wherein said blank surface comprises a single piece of fabric.
7. The method according to any preceding clause wherein said blank surface comprises fabric.
8. The method according to any preceding clause wherein said blank surface comprises metal.
9. The method according to any preceding clause wherein said blank surface comprises cardstock.
10. The method according to any preceding clause wherein said stamp comprises a die.
11. The method according to any preceding clause wherein said coloring liquid comprises paint.
12. The method according to any preceding clause wherein said coloring liquid comprises ink.
13. The method according to any preceding clause wherein said first stamp comprises a patterned stamp.
14. The method according to any preceding clause wherein said first stamp comprises a plain stamp.
15. The method according to any preceding clause wherein said first stamp comprises a square.
16. The method according to any preceding clause wherein said first stamp comprises a triangle.
17. The method according to clause 16 wherein said second stamp comprises a square.
18. The method according to any preceding clause wherein said first stamp comprises a transparent stamp.
19. A system for creating a quilted product, said system comprising:
   a blank surface
   at least two stamps, wherein said at least two stamps do not comprise added allowance.
20. The system according to clause 19 wherein one of said at least two stamps comprises a transparent stamp.
21. A method for creating a quilted product, said method comprising:
   a. using a first die cut to create a first quilted piece;
   b. using said first die cut to create a second quilted piece, wherein said second quilted piece abuts against said first quilted piece, and wherein said first quilted piece does not comprise an added allowance, and wherein said second quilted piece does comprise an added allowance.

22. The method according to clause 21 further comprising using a second die cut to create a third quilted piece, wherein said third quilted piece comprises a dissimilar shape from said first quilted piece.

23. The method according to clauses 21-22 further comprising using a second die cut to create a third quilted piece, wherein said third quilted piece comprises a dissimilar size from said first quilted piece.

24. The method according to clauses 21-23 wherein said first quilted piece comprises a fabric.

25. The method according to clauses 24 wherein said first quilted piece comprises metal.

26. The method according to clauses 21-25 further comprising securing said first quilted piece and said second quilted piece to a backing.

27. The method according to clauses 21-26 further comprising embossing said first quilted piece.

28. The method according to clauses 21-27 further comprising embossing said second quilted piece.

I claim:

1. A method for creating a product, said method comprising:

a. using a first stamp to apply a coloring liquid to a blank surface to create a first piece;

b. using a second stamp to apply a coloring liquid to said blank surface to create a second piece, wherein said second piece abuts against said first piece, and wherein said first stamp does not comprise an added allowance, and wherein said second stamp does not comprise an added allowance;

wherein said method further comprises stitching along a perimeter of at least one of said pieces.

2. The method of claim 1 wherein said first stamp and said second stamp comprise a dissimilar shape.

3. The method of claim 1 wherein said first stamp and said second stamp comprise a dissimilar size.

4. The method of claim 1 further comprising applying said blank surface to a backing.

5. The method of claim 1 wherein said blank surface comprises a single piece of fabric.

6. The method of claim 1 wherein said blank surface comprises fabric.

7. The method of claim 1 wherein said blank surface comprises metal.

8. The method of claim 1 wherein said first stamp comprises a patterned stamp.

9. The method of claim 1 wherein said first stamp comprises a plain stamp.

10. The method of claim 1 wherein said first stamp comprises a transparent stamp.

* * * * *